United States Patent [19]

Saleri et al.

[11] 4,051,971

[45] Oct. 4, 1977

[54] HOME USE SEAL CONTAINER FOR FOOD VACUUM STORAGE

[76] Inventors: Piergiorgio Saleri; Sergio Saleri, both of Via XXV Aprile 14, Rovato (Brescia), Italy

[21] Appl. No.: 628,242

[22] Filed: Nov. 3, 1975

[30] Foreign Application Priority Data

July 30, 1975 Italy ..... 5194/75

[51] Int. Cl.[2] ..... B65D 51/16

[52] U.S. Cl. ..... 215/260; 215/262; 215/228; 215/309

[58] Field of Search ..... 215/260, 262, 309, 311, 215/315, 228

[56] References Cited

U.S. PATENT DOCUMENTS

| | | | |
|---|---|---|---|
| 1,056,241 | 3/1913 | Wennersten | 215/309 |
| 3,805,788 | 4/1974 | Kleiner | 215/309 |
| 3,843,016 | 10/1974 | Bornhorst | 215/309 |
| 3,845,787 | 11/1974 | Slacle | 215/309 |
| 3,868,039 | 2/1975 | Holbrook | 215/309 |
| 3,942,679 | 3/1976 | Starr | 150/.5 |
| 3,943,987 | 3/1976 | Rossi | 150/.5 |

FOREIGN PATENT DOCUMENTS

| | | | |
|---|---|---|---|
| 90,461 | 9/1937 | Sweden | 215/309 |
| 2,344 | 1/1910 | United Kingdom | 215/315 |

*Primary Examiner*—Ro E. Hart
*Attorney, Agent, or Firm*—Haseltine, Lake & Waters

[57] ABSTRACT

A home use seal container for food vacuum storage, comprising a vessel and a lid superimposable thereon through the interposition of a resilient gasket, the lid having fast therewith two valves through one of which it is possible to remove air from the container by means of a suction pump and respectively through the other of which it is possible to introduce air into the same container.

5 Claims, 1 Drawing Figure

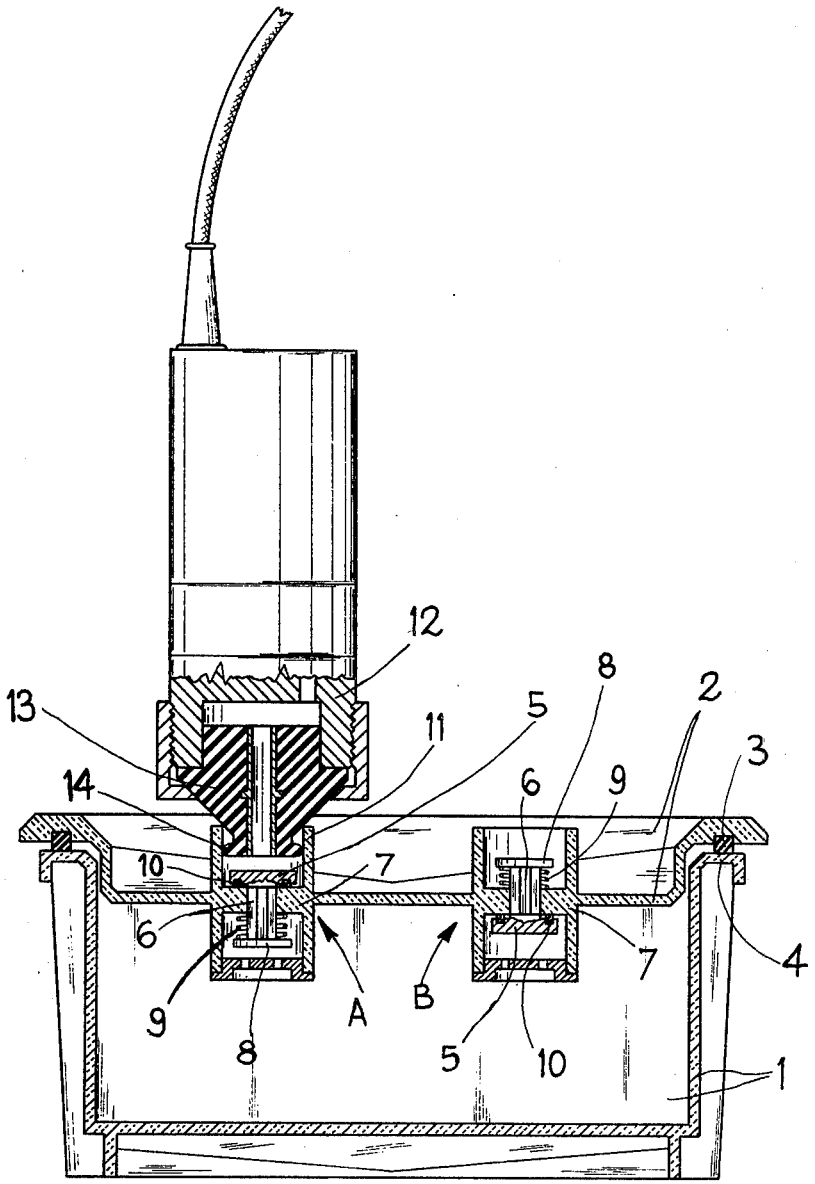
12
13
11
5
8
2
3
14
6
9
10
7
6
7
4
9
A
B
8
5
10
1

HOME USE SEAL CONTAINER FOR FOOD VACUUM STORAGE

This invention is concerned with a home use seal container for food vacuum storage.

On an industrial scale it is well known to resort very often to the techniques of extended vacuum storage for foodstuffs, preventing or retarding deterioration thereof and any loss of flavor, within containers made of different materials and different shapes.

At present, no containers and means are available for allowing in home or small community environment the storage of foods or other substances in containers, in which an air suction can then be produced.

It is the primary object of the present invention to provide a home use container, in which vacuum can be simply and economically produced whenever desired, and which is provided with manually operable members, and by means of which such a vacuum can be broken without any damage to the container.

It is another object of the invention to provide a container of the above design, which is of a simple structure and low cost.

These and still further objects are attained by a container comprising, main structural elements, a vessel and a lid sealingly superimposable thereto through the interposition of a resilient gasket, characterized in that said structural elements have at least two air seal valves fast therewith, each of the valves including a shutter normally held at closed position on an associated seating by a resilient member, the shutter of one of said valves being positiond outwardly of the container relative to its associated seating and being enclosed by a union forming part of the valve and making up a housing for coupling to a suction pump, the shutter of the other valve being positioned inwardly of the container relative to its associated seating and being movable away from said seating by manual pressure exerted on an operating member which is part of the valve.

In order that the structure and features of a container according to the present invention be more clearly understood, an embodiment of the invention will now be described by mere way of unrestrictive example, reference being had to the accompanying drawing, the single FIGURE of which is a sectional view showing a container having an end of a suction pump bearing thereon.

As it will be seen in the drawing, the container comprises its main structural elements, a vessel 1 and a lid 2 superimposable thereon by the interposition of a continuous resilient gasket 3, which can be fast with either the lid or the free edge 4 of vessel 1.

Lid 2 has two valves A and B fast therewith having identical structure to each other.

Each of said two valves comprises a shutter 5 fast with one end of a tab-shaped stem 6 passing through a hole of circular cross-section in the valve wall 7: the other end of each stem 6 has a cap 8 fast therewith, with a spring 9 acting between said cap wall 7 and tending to hold said shutter 5 pressed against wall 7 at a position in which, owing to a continuous resilient gasket 10, said shutter ensures the valve seal, that is prevents air from passing through the valve.

As it will be seen in the drawing, the shutter of valve A is positioned on the outer side of lid 2, while the shutter of valve B is positioned within the lid. Cap 8 of valve B is positioned so that it can be pressed by a finger to move shutter 5 away from its associated seating 7, and shutter of valve A is enclosed by a continuous union

11 defining a seating for sealingly accomodating the inlet of a suction pump.

In the drawing, the end of any known type of suction pump 12 has been shown comprising a conical casing 13 made of resilient material, and an annular edge 14 projecting therefrom. When the pump end is superimposed on valve A and edge 14 is inserted within union 11 and the conical surface of casing 13 is held slightly pressed against the free edge of the union, if the pump is operating, it will cause lifting of shutter 5 and air removal from the container, while valve B remains in closed condition. The external atmospheric pressure presses lid 2 against gasket 3, thus assuring the container sealing.

Particularly, it will be appreciated that spring 9 of valve B can be calibrated to open upon reaching a predetermined degree of vacuum within the container.

To open the container, a pressure by a finger is exerted on cap 8 of valve B for air passage, so that said lid 2 can be lifted.

Valves can be other than those shown in the drawing. For, example, at least valve A can be a ball type of valve. Of course, instead of the suction pump inlet, a shaped end of a hose can bear on valve A, the hose being connected in turn to a suction pump which, for example, can be fast with a wall.

The container can be made of any suitable material, such as plastic material, and can be shaped for stable superimposition on other identical containers. For example, the container may be of such a configuration that it can be inserted within a refrigerator, juxtaposed or superimposed on other identical containers so as to completely or partially fill up the refrigerator space. In such a case, instead of being superimposed on the vessel, the container lid can be conveniently brought to bear on a mouth of the vessel facing the refrigerator door: thus, the lid of each container can be opened without removing it from the refrigerator.

The above described containers are of a simple structure and low cost, whereby the use thereof is in the possible range of any family, allowing an extended storage of foods, particularly where the containers are put into a refrigerator after evacuating the containers.

We claim:

1. Home use seal container apparatus for food vacuum storage, comprising as main structural elements a vessel and a lid superimposable on said vessel to form a storage chamber, a resilient gasket between said vessel and lid, an air seal valve secured with one of said structural elements, said valve comprising a housing integral with said one structural element and including a union projecting therefrom in a direction away from the other structural element, a flat shutter normally held in a closed position against an associated seating, a stem secured to said shutter, said stem extending with clearance through an aperture provided in said one structural element, a cap on said stem, a resilient member acting on said cap to urge the shutter to said closed position, and a suction pump comprising a casing of resilient material including an annular edge portion, said edge portion being dimensioned for insertion into said union to a given depth therein to form a sealed relation of said casing with said housing such that suction pressure developed by said pump will produce lifting of said shutter against the action of said resilient member and removal of air from the container, and means for selectively releasing suction pressure from within said storage chamber.

2. Apparatus as claimed in claim 1 wherein said one structural element includes a wall which is provided with said aperture, said union projecting in one direction from said wall, said housing including a second portion projecting from said wall in the opposite direction, said cap and resilient member and a portion of said stem being in said second portion.

3. Apparatus as claimed in claim 2 wherein said resilient casing of the suction pump and said housing having mating surfaces forming said sealed relation, one of said mating surfaces being conical.

4. Apparatus as claimed in claim 3 wherein said annular edge portion is in spaced relation with said shutter when the mating surfaces are in sealed relation.

5. Apparatus as claimed in claim 1, wherein said shutter comprises a disc secured to said stem at one end thereof, said cap being secured to said stem at the other end thereof.

* * * * *